United States Patent [19]

Kordich et al.

[11] Patent Number: 4,648,461

[45] Date of Patent: Mar. 10, 1987

[54] FLUID PRESSURE DISCHARGE SAFETY SYSTEM

[75] Inventors: Michael M. Kordich, Fredericksburg; John W. Shea, King George, both of Va.

[73] Assignee: The United States of America as represented by the Secretary of the Navy, Arlington, Va.

[21] Appl. No.: 749,976

[22] Filed: Jul. 1, 1985

[51] Int. Cl.[4] ..... A62G 37/00

[52] U.S. Cl. ..... 169/60; 137/71

[58] Field of Search ..... 169/54, 60, 56, 57; 251/66; 137/68 R, 68 A, 71

[56] References Cited

U.S. PATENT DOCUMENTS

| | | | |
|---|---|---|---|
| 2,537,074 | 1/1951 | Mapes | 169/2 |
| 2,912,992 | 11/1959 | Gasche et al. | 137/70 |
| 3,001,586 | 9/1961 | Kyle | 169/2 |
| 3,042,057 | 7/1962 | Zorgdrager et al. | 137/70 |
| 3,052,303 | 9/1962 | Lapp | 169/2 |
| 3,346,232 | 10/1967 | Cator | 251/66 |
| 3,703,930 | 11/1972 | Lofstrand | 169/2 |

*Primary Examiner*—Jeffrey V. Nase
*Assistant Examiner*—Kevin P. Weldon
*Attorney, Agent, or Firm*—Elmer E. Goshorn; Thomas E. McDonnell

[57] ABSTRACT

Improved fluid pressure discharge safety system for automatically detecting and simultaneously suppressing opposed exhaust streams of an accidentally fired and stored missile. The system is generally made up of first and second nozzles for discharging sprays of fluid under pressure. The first nozzle is provided with an exhaust detection arrangement. This arrangement includes a discharge control plug that maintains the first and second nozzles in a securely closed condition for preventing discharge of pressure fluid from either nozzle. However, the detection arrangement, when impacted by an exhaust stream, causes ejection of the fluid pressure discharge control plug from the first nozzle thereby opening the first nozzle for discharge of pressure fluid therefrom. A first valve of novel construction is operatively associated with the plug and controls the operation of a second valve. The second valve controls the discharge of pressure fluid from the second nozzle. When the discharge control plug is ejected and the second valve is opened, both nozzles discharge separate sprays of pressure fluid that envelope the opposed exhaust streams of an ignited and stored missile associated therewith. This envelopment by either spray is in effect a fluid pressure safety shield that effectively reduces hazards to personnel and adjacent stored missiles.

13 Claims, 6 Drawing Figures

FLUID PRESSURE DISCHARGE SAFETY SYSTEM

This invention relates to a fluid pressure discharge safety system for minimizing hazards where dangerous conditions exist; and, more particularly, it relates to an improved fluid pressure discharge safety system for detecting and suppressing opposed exhaust streams of an accidentally fired and stored missile that would otherwise endanger personnel.

BACKGROUND OF THE INVENTION

Various designs and techniques have been developed in the past in providing automatic fluid pressure sprinkling systems for either extinguishing or suppressing a fire hazard. For example, U.S. Pat. No. 2,537,074 to Mapes relates to an aircraft fire extinguishing system. The system is generally made up of a fire extinguishing medium storage container, a cartridge-shatterable valve disc and a conduit distribution network to an engine nacelle. When a fire occurs in an engine nacelle during aircraft flight, the cartridge is actuated electrically to shatter the valve disc and release the stored medium to the engine nacelle to stop the fire. U.S. Pat. No. 3,052,303 to Lapp concerns a fluid pressure discharge safety system for detecting and suppressing an exhaust stream of a stored missile. The system is generally made up of a fluid discharge control nozzle and a mechanically locked flap valve for closing the nozzle. When the propellant of a stored missile accidentally fires, the exhaust stream impacts a latch to release the flap valve and discharge a flow of pressure fluid from the nozzle to suppress the stored missile exhaust stream. U.S. Pat. No. 3,001,586 to Kyle concerns another safety system for a stored missile or rocket. The system is generally comprised of a discharge nozzle and a fluid pressure responsive plug for closing the nozzle. An exhaust stream detection device not only releasably locks the plug to the nozzle but also it is releasably wire locked in its initial position to the nozzle frame prior to ignition of a stored missile associated therewith. Upon ignition of the missile, the detection device wire lock is fractured thereby advancing the detection device relative to the plug, unlocking same; and thus, causing it to be ejected from the nozzle. By reason of the plug being ejected a flow of pressure fluid is discharged from the nozzle to suppress the exhaust stream. U.S. Pat. No. 3,703,930 to Lofstrand et al. relates to a safety system for a naval vessel missile magazine. The system is generally made up of a fluid pressure discharge nozzle to suppress a stored missile exhaust stream for each missile storage station. An overhead secondary fluid pressure spray apparatus is also provided with each station. Upon release of the nozzle plug when a fired missile is detected, a complex sensing and check valve arrangement causes operation of the secondary spray fluid pressure discharge control valve so as to cause dispensing of additional fluid to primarily quench the nonexhaust portions of the missile. However, none of the aforediscussed references, whether taken alone or in any combination remotely suggest an improved fluid pressure discharge safety system for detecting and suppressing opposed exhaust streams of a stored missile. The system is provided with, among other things, first and second pressure fluid discharge control nozzles operatively associated with its respective missile and a releasably locked discharge control plug associated with one of the nozzles that not only is positively maintained in its nozzle inserted position for preventing first nozzle discharge but also it is directly operatively connected to a novel first valve for controlling the operation of a second valve of the second nozzle so as to also prevent second nozzle discharge until the system detects an exhaust stream of a fired missile associated therewith.

SUMMARY OF THE INVENTION

An object of the invention is to provide an improved fluid pressure discharge safety system of simple and easily serviceable construction for automatically detecting and suppressing opposed exhaust streams of a stored and accidentally fired missile.

Another object of the invention is to provide an improved fluid pressure discharge safety system for detecting and continuously suppressing opposed exhaust streams of a stored missile wherein only a single detection device is required for controlling the discharge operation of both nozzles.

Still another object of the invention is to provide an improved fluid pressure discharge safety system for detecting and suppressing opposed exhaust streams of a stored missile that can be readily incorporated into an existing fire fighting system for a naval vessel and the like.

Yet another object of the invention is to provide an improved fluid pressure discharge safety system for a stored missile wherein the detection device together with a novel valve device cooperatively engage the ejectable plug of one of two discharge nozzles of the system so as to positively maintain both nozzles in a nonoperative condition until a fired missile is detected.

Yet still another object of the invention is to provide an improved fluid pressure discharge safety system that can be easily rebuilt after each use in suppressing the opposed exhaust streams of an accidentally fired and stored missile thereby enabling repeated use of the system.

In summary, the improved fluid pressure discharge safety system is generally made up of first and second pressure fluid discharge nozzles not only for detecting one of the opposed exhaust streams of a stored and accidentally fired missile but also for simultaneously suppressing opposed exhaust streams thereof. The first nozzle is provided with an ejectable and fluid pressure responsive plug that is inserted and releasably secured in the nozzle bore at its discharge end in order to prevent fluid pressure discharge until a fired missile is detected. The outer end of the plug is provided with an open end chamber for receiving a detection device. The detection device is generally comprised of an outer disc upon which the missile stream impacts and an inner plunger that is slidably connected to the plug in the chamber thereof. The first nozzle at its discharge end is provided with an annular recess in open communication with the bore. The plug is provided with a series of circumferentially spaced radial passageways that are alignable with the recess when the plug is inserted into the bore of the nozzle. Each one of a series of locking balls is first inserted into its respective passageway and then each ball is interposed between its passageway and associated portion of the recess when the plug is inserted in the nozzle bore so as to initially secure the plug to the first nozzle. After the locking balls are inserted, the detection device is positioned relative to the plug so that the plunger closes off the passageways thereby retaining each ball in its respective passageway. A frangible locking pin extends between the detection device and the plug at the outer end thereof so as to positively lock the detection device to the plug. This locking assures, for all practical purposes, that each locking ball is retained in its passageway and the plug is not ejected from the nozzle until a fired missile is detected.

A first valve device is mounted on and connected to the first nozzle for controlling the operation of a second valve device. The second valve device is fluid-pressure operated and is connected to the second nozzle for controlling the discharge thereof. The first nozzle valve device is provided with a housing that has an opening between its ends for slidably receiving a valve spool. One end of the opening is in direct open communication with an aperture in the first nozzle. The aperture is in direct open communication with the first nozzle bore when the plug is ejected therefrom. The valve spool includes a stem, the outer end of which is provided with a series of interengaging balls. The outermost ball of the series is disposed in direct engagement with the plug when it is inserted in the bore.

A common pressure fluid source is separately connected to each inlet of the first and second nozzles. The pressure fluid source is also parallel connected to the first and second nozzle valve devices. The fluid pressure source in being connected to the first nozzle valve device biasingly urges the valve spool in a direction such that the outermost ball of the stem is maintained in positive engagement with the inserted plug.

When the trailing exhaust stream of an accidentally fired and stored missile impacts against the disc of the system detection device, the pin is fractured thereby advancing the plunger of the detection device relative to the plug so as to uncover the plug locking balls and thus enable them to drop into the chamber. Such dropping of the balls frees the plug and ejects it from the nozzle due to the pressure fluid acting thereon.

The first nozzle valve device is provided with a series of bleed ports that are normally closed off by the valve spool when the outermost stem ball is in engagement with the inserted plug. However, when the plug is ejected from the first nozzle, the stem balls, because of the biasing action of the pressure fluid source acting on the valve spool, are advanced through the first nozzle aperture into the first nozzle bore. At the same time the stem balls are advanced, the spool is also advanced to uncover the series of bleed ports thereby placing the fluid pressure source in direct open communication with the bleed ports. As the result of the pressure source being discharged through the series of bleed ports, the fluid pressure in the parallel connection is reduced thereby causing operation of the second nozzle discharge valve device from a normally closed position to an open position.

With both nozzles now discharging separate sprays of pressure fluid from the common source, each nozzle fluid pressure discharge spray envelopes its associated exhaust stream of the fired missile so as to form in effect a continuous spray shield thereabout. The spray shield formed by each discharging nozzle suppresses its associated exhaust stream of the fired missile until the ignited and burning propellant thereof is expended thereby significantly reducing the hazards to adjacent stored missiles and personnel.

Other objects and advantages of the invention will become apparent when taken in conjunction with the accompanying specification and drawings as follows:

DETAILED DESCRIPTION OF THE INVENTION

Figure 1:
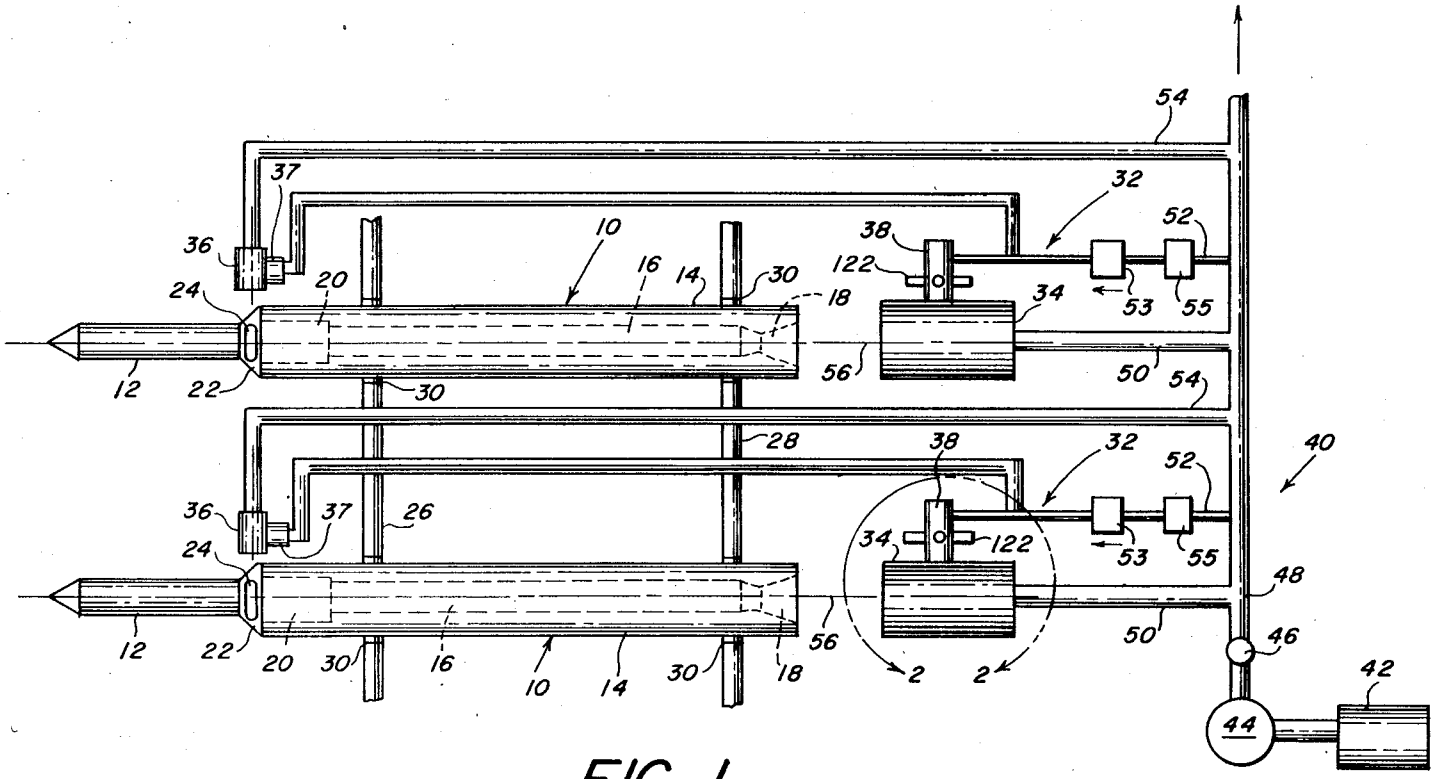
FIG. 1 is a diagrammatic view with parts removed and other parts broken away and illustrates an embodiment of the invention for use with a missile storage magazine.
Figure 3:
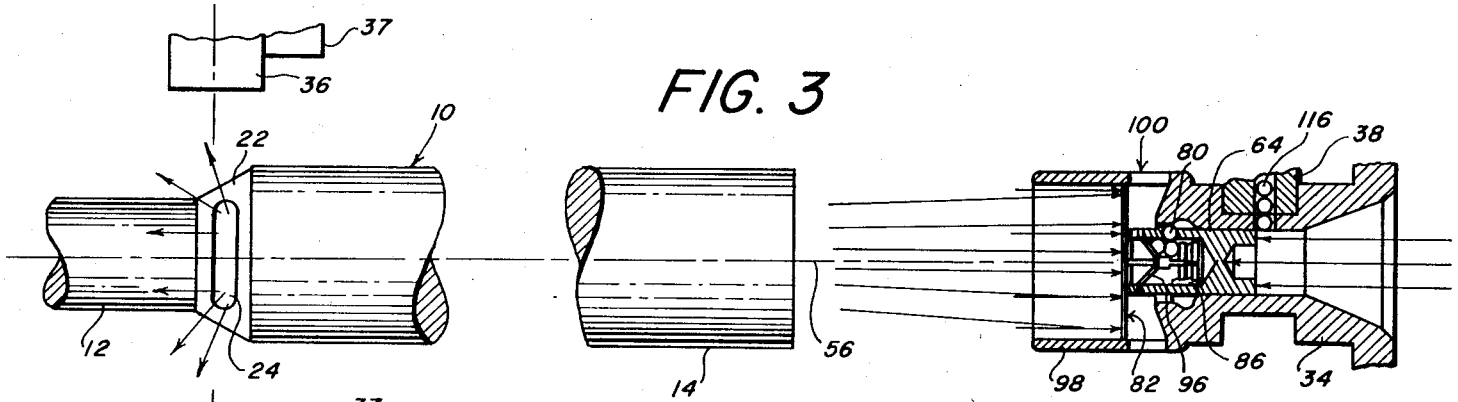
FIG. 3 is a combined fragmented diagrammatic and longitudinal sectional view with parts removed and illustrates a stored missile with its burning and ignited propellant emitting opposed exhaust streams prior to an operative mode of the safety system of the invention.

With reference to FIG. 1 a series of missiles 10 (only two of which are shown) are stored in a magazine. Each missile is generally made up of a warhead 12 and a trailing section 14. Each section is provided with a solid propellant-filled chamber 16, an exhaust nozzle 18 and an ignition safety lock mechanism 20. An adapter ring 22 is interposed between and connected to warhead 12 and section 14 of each missile. The adapter ring is provided with a series of at least two relatively spaced exhaust ports 24 (only one of which is shown in FIG. 1). Each port 24 is of elliptical shaped configuration. As evident from FIG. 1. each missile is supported by a pair of spaced framework elements 26 and 28 having longitudinally aligned slots 30 for receiving a missile. One of the purposes of ignition safety lock mechanism 20 is to vent a portion of the exhaust stream of an accidentally ignited propellant in chamber 16 of a stored missile through outer adapter ring ports 24 of a stored missile. By reason of mechanism 20, in effect, equally dividing exhaust streams of ignited propellant in chamber 16 through ports 24 and nozzle 18, and since the exhaust streams of port 24 and nozzle 18 extend in generally opposite directions, the ignited missile is not propelled but stays in its stored position as indicated in FIG. 3. However, since the opposed exhaust streams of an accidentally ignited and stored missile are not only hazardous to the safety of surrounding equipment and adjacent stored missiles as well as personnel, an improved fluid pressure discharge safety system 32 for automatically detecting and effectively suppressing the opposed exhaust streams of the stored missile has been developed as will now be described.

By virtue of the safety system being identical for each stored missile, description of one safety system 32 will suffice for all unless otherwise specified. As also generally indicated in FIG. 1, system 32 is generally made up of relatively spaced first and second fluid pressure discharge control nozzles 34 and 36. A fluid pressure operated valve 37 is connected to second nozzle 36 for controlling the discharge of pressure fluid therefrom. A valve 38 for controlling the operation of valve 37 is operatively connected to and mounted on first nozzle 34. A fluid pressure source 40, which is usually water from a fire fighting system of a naval vessel, is generally made up of a supply tank 42, a pump 44, a control valve 46, main supply line 48 and a series of three branch lines 50, 52 and 54. Tank 42 is provided with an inlet (not shown) that is usually connected to sea water. Branch line 52 is parallel connected to valves 37 and 38. A pressure responsive check valve 53 and orifice 55 are connected to line 52 before valve 38 and before the parallel connection of line 52 to valve 37. The purpose of check valve 53 and orifice 55 will become more apparent hereinafter. Each branch line 50 or 54 is directly connected to the inlet of its associated nozzle 34 or 36. As shown in FIG. 1, the longitudinal axis 56 of nozzle 34 is aligned with the axis of stored missile 10. However, the axis of nozzle 36 is disposed generally transverse to the axis of missile 10. For the sake of brevity, the framework for supporting nozzles 34 and 36 in relation to its associated missile 10 is not shown.

Figure 2A:
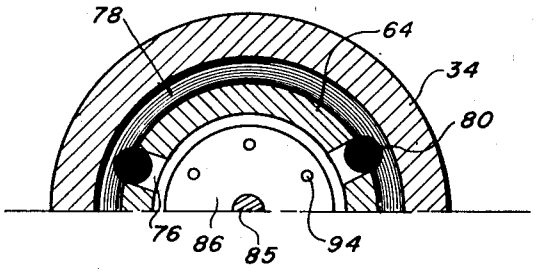
FIG. 2A is an enlarged cross-sectional view with parts removed as taken along line 2A—2A of FIG. 2 and illustrates further details of the invention.
Figure 2:
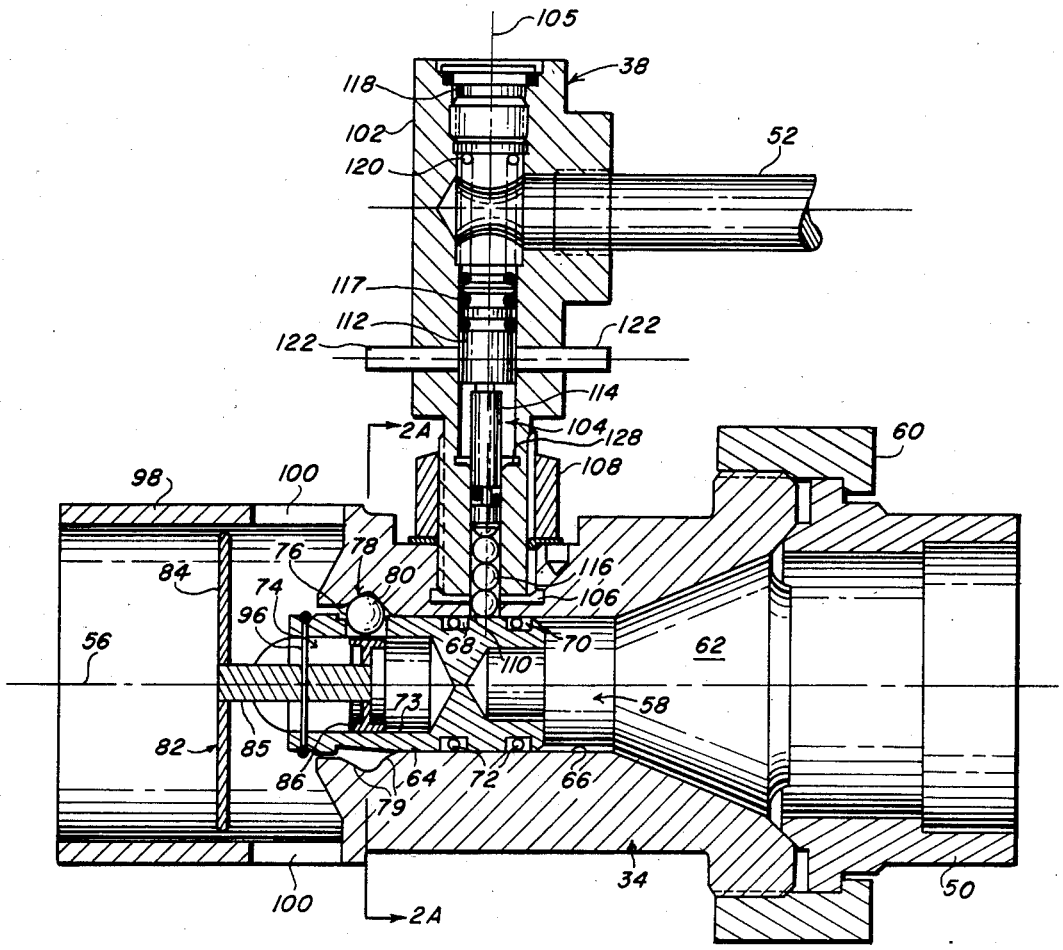
FIG. 2 is an enlarged longitudinal sectional view taken within the bounds of encompassing line 2—2 of FIG. 1 and illustrates certain details of one of the fluid pressure discharge control nozzles of the invention.

As indicated in FIG. 2, nozzle 34 has a longitudinal bore 58 between its ends. Branch line 50, in being sealably connected to the inlet of nozzle 34, is effected by a flanged and threaded collar 60 in a known manner. Since the discharge end of bore 58 has a smaller diameter than the internal diameter of supply line 50, the inlet of nozzle bore 58 converges in a direction toward the discharge end of nozzle 34. A suitable vane-type device 62 is advantageously mounted at the inlet of bore 58 for imparting a rotating direction to a flow of pressure fluid about nozzle axis 56 as it passes through the nozzle.

A fluid pressure responsive and ejectable plug 64 of cylinder-like configuration is inserted in bore 58 at the discharge end. To facilitate the insertion and sealing connection of plug 64 to interior cylindrical surface 66, which defines the discharge end of bore 58, a pair of longitudinally spaced grooves 68 and 70 are provided in plug 64 for receiving o-rings 72. The outer end of plug 64 is hollowed out and provided with an inwardly extending open end chamber 74 that is concentric about the axis of plug 64. A series of three radial and relatively spaced passageways 76 are provided about the periphery of plug 64 at the outer end thereof. For the sake of brevity, only two of the passageways are shown in FIG. 2A. A radial passageway 76 is preferably spaced one hundred twenty degrees (120°) from each of the other passageways. The purpose of these passageways will become more fully apparent hereinafter. Each passageway 76 extends between the outer surface of plug 64 and an interior cylindrical surface 73 thereof that defines the outer radial extent of chamber 74. Hence, each passageway 76 is in direct open communication between the outer surface of plug 64 and chamber 74 thereof. An annular recess 78 is formed in surface 66 at the discharge end of bore 58 and extends in a direction generally radiallv outward to surface 66. The outward radial extent of recess 78 is defined by a V-shaped annular surface 79 that is interposed between the ends of surface 66 as best shown in FIG. 2. The axial extent of recess 78 is such that it substantially corresponds to the diameter of each passageway 76. Each one of a series of three plug-locking balls 80 are inserted in its respective passageway 76. The diameter of each ball 80 is such that, when a plug 64 is inserted in bore 58 and the series of three passageways 76 of the plug are aligned with recess 78 of nozzle 34, a ball 80 can be freely inserted in its respective passageway 76 until it is partially inserted in its associated portion of recess 78. The diameter of each ball 80 is such that when the bottom of each ball 80 is inserted in its respective passageway 76, and partially inserted in its associated portion of recess 78, it is substantially flush or tangent to plug interior surface 73.

A missile exhaust stream impact and detection device 82 is slidably connected and releasably secured to the outer end of plug 64, as also shown in FIG. 2. Device 82 is generally comprised of an outer disc 84 of relatively thin construction and an inner plunger 86 of wheel-like configuration. A shaft 85 extends between the disc and plunger 86. Disc 84 and plunger 86 are appropriately secured to opposite ends of shaft 85. Plunger 86 has an outside diameter substantially corresponding to the internal diameter of plug surface 73. Also, plunger has an axial extent substantially equal to the diameter of a plug passageway 76. By reason of plunger 86 having a diameter substantially equal to the diameter of surface 73, plunger 86 is slidably connected to plug 64 when detection device 82 and its plunger 86 is inserted in chamber 74 and slidably connected to the outer end of plug 64. To prevent the creation of suction between plunger 86 and plug 64 when the plunger is connected thereto, a series of vent holes 94 are provided in plunger 86 as shown in FIG. 2A.

Figure 4:
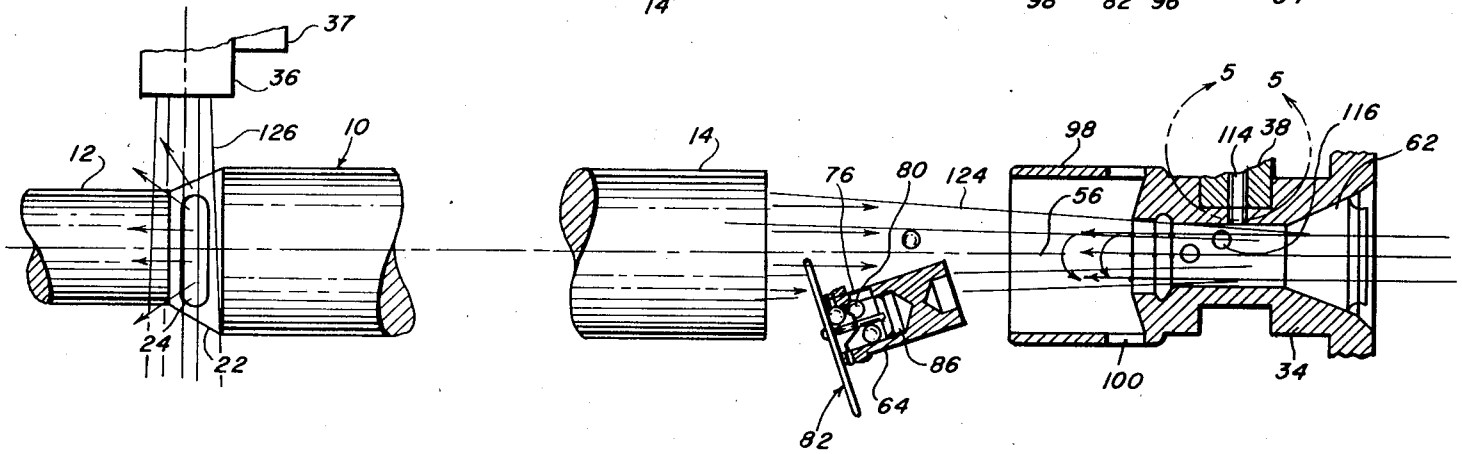
FIG. 4 is a combined fragmented diagrammatic and longitudinal sectional view similar to FIG. 3 but with the safety system of the invention in an operative suppression mode after detection of the stored missile exhaust streams.

An annular shield 98 is disposed about and affixed to the discharge end of nozzle 34. Shield 98 has a diameter greater than the diameter of disc 84. Shield 98 has a length that extends beyond disc 84 so as to provide a protective cover for the disc. Further, the shield includes diametrically opposed vent openings 100. The shield also serves to direct and concentrate a missile exhaust stream in impacting against disc 84 so as to cause fracture of pin 96, inward advancement of plunger 86 relative to plug 64, dropping the series of balls 80 from the series of passageways 76 as best shown in FIG. 3, and ejection of plug 64 from the discharge end of nozzle 34 as depicted in FIG. 4 and as will become more fully apparent hereinafter.

In assembling device 82 to plug 64, and plug 64 to nozzle 34, the plug is initially inserted in nozzle 34 at its discharge end until passageways 76 are aligned with recess 78. Each ball 80 is inserted in its passageway 76 and retained therein by the inserted ball having a suitable coating of relatively thick grease-like material. After inserting and retaining each ball 80 in its passageway 76, plunger 86 of device 82 is inserted in chamber 74 of plug 64 until the plunger fully covers the bottom of passageways 76 thereby retaining each ball 80 in its inserted position of its associated passageway and portion of recess 78 as shown in FIG. 2. With the plunger of device 82 properly inserted in plug chamber 74, a frangible pin 96 is inserted and extends between aligned openings in the outer end of plug 64 and an intermediate portion of shaft 85 in order to firmly secure shaft 85 and plunger 86 to plug 64. Vent openings 100 of shield 98 provide access to the interior of the shield between disc 84 and the discharge end of nozzle 34 so as to enable insertion of pin 96 between the aligned openings at the outer end of plug 64 and an intermediate portion of shaft 85. Insertion of pin 96 securely and releasably locks plug 64 to the discharge end of nozzle 34 by reason of the series of locking balls being in their respective passageways 76 and associated portions of recess 78 as aforedescribed.

Bleed valve 38 for controlling the discharge of second nozzle 36 is operatively connected to and mounted on nozzle 34 between its ends as illustrated in FIG. 2. Valve 38 is provided with a housing 102 having an opening 104 between its ends. The lower end of housing 102 is inserted in an opening 106 at the upper portion of nozzle 34 and theadedly connected thereto. A lock nut 108 is provided for securing valve housing 102 to nozzle 34. Nozzle 34 is provided with an aperture 110 that extends between the bottom of opening 106 and nozzle interior surface 66 so as to provide direct open communication between bore 58 and opening 106 when plug 64 is ejected. Aperture 110 is also axially aligned with axis 105 of opening 104. A valve spool 112 is slidably connected to housing 102 in the upper enlarged end of opening 104. A valve stem 114 is connected to the lower end of spool 112 and is slidably connected to housing 102 in the lower reduced end of opening 104. The lower end of stem 114 is provided with a series of three interengaging and longitudinally aligned balls 116. The diameter of each ball 116 is such that it slides freely in the lower reduced end of openings 104 as well as slides freely through nozzle aperture 110.

Figure 5:
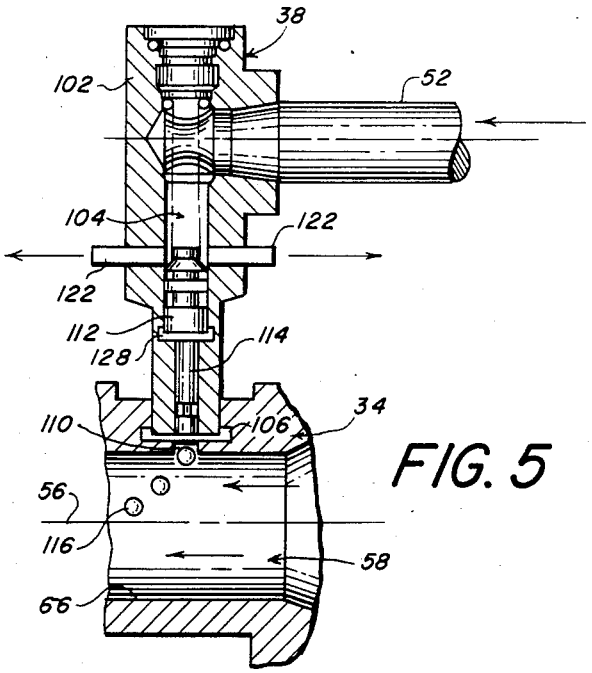
FIG. 5 is an enlarged cross-sectional view taken within the bounds of encompassing line 5—5 of FIG. 4 with parts added and other parts removed and illustrates further details of the fluid pressure discharge control nozzle in FIG. 2.

The upper enlarged end of opening 104 is closed off by a plug-type element 118. A coil spring 120 is interposed between element 118 and spool 112 for biasingly urging spool 112 in a direction towards the lower end of housing 102 so as to biasingly urge the lowermost or outer ball 116 into engagement with plug 64 when it is in its inserted position in nozzle 34 as aforedescribed. Branch line 52, in being connected to the upper end of housing 102, is in direct open communication with the upper end of bore 104 as shown in FIG. 2. By reason of the pressure fluid in line 52 during use of system 32, the pressure fluid will exert a force on spool 112 to maintain lowermost ball 116 in positive engagement with plug 64 in its inserted position. Valve spool 112 is provided with a pair of longitudinally spaced o-ring receiving grooves 117. Housing 102 between its ends is provided with a series of bleed ports 122 (only two of which are shown in FIG. 2). When lowermost ball 116 engages inserted plug 64, valve spool 112 prevents fluid intercommunication between bleed ports 122 and branch line 52. However, when plug 64 is ejected from nozzle 34, valve spool 112 is biasingly advanced against housing shoulder 128 such that the upper end of the spool is disposed below ports 122 thereby providing fluid intercommunication between branch line 52 and ports 122 as depicted in FIG. 5. At the same time, the series of balls 116 are dispensed into a flow of discharging pressure fluid in nozzle bore 58.

In an operative embodiment of system 32, when a stored missile associated therewith has its propellant accidentally or otherwise ignited, the trailing exhaust stream of outwardly diverging conical shape impacts against disc 84 of detection device 82 as shown in FIG. 3. The impact force of the stream engaging the, outer face of disc 84 causes fracture and bending of pin 96 so as to advance plunger 86 further into chamber 74 of plug 64. Such advancement of plunger 86 uncovers balls 80 and causes them to be dropped or forced into chamber 74 between plunger 86 and pin 96. By virtue of V-shaped surfaces 79 of nozzle 34, each ball 80 of the series of balls 80 is easily forced into its associated passageway 76 of the series of passageways 76 in a direction toward plug chamber 74 as plug 64 is beginning to be ejected from nozzle 34 due to the influence of pressure fluid acting on the inner end of the plug. It is noted here that the outer end of shield 98 is sufficiently spaced from the trailing end of a stored missile 10 so that the ejected plug will freely fall between the missile and shield 98 as depicted in FIG. 4. However, the outer end of shield 98 could be more closely spaced to the exhaust end of missile 10 if desired. In this case, the ejected plug would probably be forced into the nozzle of the missile despite the exhaust stream. Even though disc 84 and plug 64 appear to have a size similar to the missile nozzle opening as shown in FIGS. 1 and 3–4, the disc and plug are in fact much smaller in size than the missile nozzle opening; and thus, would not interfere with either the exhaust stream itself or the discharge of pressure fluid from nozzle 34 for encompassing the stream during system 32 use.

At the same time plug 64 is ejected, the lowermost ball 116 of bleed valve 38 is no longer in engagement with plug 64. Consequently, because of the biasing action of pressure fluid from line 52 on the upper end of spool 112, the series of balls 116 are dispensed into bore 58 as shown in FIG. 5. With the dispensing of balls 116, spool 112 abuts shoulder 128 of housing 102 such that the upper end of spool 112 is disposed below bleed ports 122 thereby providing fluid intercommunication between branch line 52 and ports 122.

By reason of branch line 52 having flow restriction orifice 55, the flow of pressure fluid to valves 37 and 38 is restricted. Consequently, when valve 38 is opened the flow of pressure fluid to valve 37 is reduced. This flow reduction then reduces the pressure of fluid in line 52 between valves 37 and 38 thereby also opening valve 37. With valve 37 being opened, second nozzle 36 is opened for discharging a spray of pressure fluid. Although not heretofore mentioned, valve 37 can be any suitable commercially available fluid-operated discharge control valve for a nozzle. The construction of valve 37 is such that it is fluid biased to a closed position but spring biased to an open position when the fluid pressure is reduced in fluid pressure supply line as in branch line 52 for controlling valve 37 as aforedescribed.

With plug 64 ejected from nozzle 34, each nozzle 34 and 36 is discharging a continuous spray of pressure fluid 124 and 126 to envelope an opposing exhaust stream at the forward or trailing end of the ignited missile. As indicated in FIG. 4, device 62 induces rotary motion into the fluid about nozzle axis 56 so that the discharging fluid disperses outwardly in a divergent manner to substantially envelope the exhaust stream. This envelopment forms in effect a continuous spray shield about the exhaust stream that cools and suppresses same, until the ignited propellant of the missile is fully expended, thereby minimizing hazards to adjacent stored missiles, and equipment as well as exposed personnel. For the sake of simplicity the details of second nozzle 36 are not shown. However, nozzle 36 could be of similar configuration as nozzle 34 but without detection device 84 and ejectable plug 64. Although only one nozzle 36 is shown in relation to missile ports 24, the nozzle could be a series of jet-type nozzles mounted on a ring and interconnected by a fluid pressure manifold. When the missile has fully expended its ignited propellant, valve 46 can be turned off, plug 64 is reinstalled in nozzle 34 as aforedescribed. Then with nozzle 34 assembled for reuse, another missile is stored in relation thereto and valve 46 turned on again for further use of system 32. Thus, system 32 is repeatedly useable with minimal difficulty and therefore always provides an effective safety arrangement for stored missiles.

One of the reasons for check valve 53 is to prevent flow of fluid from the check valve of line 52 toward orifice 55 of the same line, such as when pump 46 malfunctions and there is a loss of fluid pressure in line 48. Hence, check valve 53 assures that valves 37 and 38 are not accidentally opened if a loss of fluid pressure occurs in line 48.

Obviously, many modifications and variations of the present invention are possible in light of the above teachings. It is therefore to be understood that, within the scope of the appended claims, the invention may be practiced otherwise than as specifically described.

What is claimed is:

1. A fluid pressure discharge safety system for detecting and suppressing opposed exhaust streams of an accidentally fired and stored missile, the missile being provided with an exhaust nozzle at its trailing end for generating one of the opposed exhaust streams and also being provided with adapter ring means that include exhaust port means disposed adjacent but spaced from the forward end of the missile, the exhaust port means for generating the other one of the opposed exhaust streams, said system comprising:

first nozzle spray means having interior surface means between its fluid pressure discharge and inlet ends such that the surface means defines the longitudinal bore therebetween, the discharge end of the first nozzle spray means being disposed in operative and spaced relation to the exhaust nozzle of a stored missile, the first nozzle spray means having an aperture interposed between its ends and in direct open communication with the bore, second nozzle spray means disposed in operative and spaced relation to the exhaust port means of the adapter ring means of the stored missile, fluid pressure responsive plug means being insertable and slidably connectable in the bore of the first nozzle spary means at the discharge end thereof and also being ejectable from the discharge end thereof, said plug means having an open end chamber at the outer end thereof, missile nozzle exhaust stream detection means having plunger means, said plunger means being inserted in the chamber of the plug means and slidably connected to the plug means in the chamber thereof, recess means provided in the interior surface means of the first nozzle spray means and arranged in communication with the bore, a plurality of relatively spaced radial passageway means provided in the plug means, each of the radial passageway means being in direct open comunication between the chamber of the plug means and the exterior thereof, a series of locking ball means, each one of the locking ball means being inserted in its associated passageway means of the plug means and also in the recess means of the first nozzle spray means when the plug means is in its inserted position in the bore of the first nozzle means, the plunger means being positionable in the chamber of the plug means in order to cover all of the radial passageway means so as to initially hold each inserted locking ball means of the series of locking ball means between the recess means and its associated radial passageway means of the plurality thereof, frangible locking pin means extending between said plug means and said detection means in order not only to firmly secure the plunger means in a position for covering the plurality of radial passage way means but also to firmly hold each inserted locking ball means of the series of locking ball means between the recess means of the first nozzle spray means and its associated passageway means of the plurality of the plug means thereby releasably securing the plug means in its inserted position in the bore of said first nozzle spray means so as to prevent discharge of pressure fluid therefrom, first valve means having an opening therein, said first valve means being connected to the first nozzle spray means such that one end of the opening is arranged in open fluid intercommunication between the aperture of the first nozzle spray means and the bore thereof when the aperture is not covered by the plug means in its inserted position in the bore of said first nozzle means, second valve means connected to the second nozzle spray means, the second valve means for controlling the operation of the second nozzle spray means for discharging a spray of pressure fluid from said source means, fluid pressure source means having branch conduit means connected to each inlet of the first and second nozzle spray means, said fluid pressure source means also having other conduit means parallel connected to the first and second valve means, said first valve means having bleed port means, the port means being in open fluid communication with the opening between its ends, valve spool means slidably mounted in the opening of the first valve means for reciprocal movement between its ends, the valve spool means having stem means for engaging the plug means when the plug means is in its inserted position in the bore of the first nozzle spray means, the stem means being advanceable through the aperture when the plug means is ejected from the first nozzle spray means, said other conduit means being connected to the other end of the opening of first said valve means, the fluid pressure source means of said other conduit means for continuously and biasingly urging the valve spool means and stem means in a direction toward the one end of the opening in order that the stem means is maintained in engagement with the plug means so as to hold the valve spool means in a position for closing off fluid communication between the port means and the other conduit means upon the plug means being in its inserted position in the bore of the first nozzle spray means, and said detection means having missile exhaust stream impact means for detecting the existence of a missile exhaust stream when the propellant of a missile associated with said detection means is ignited and then the ignited propellant causes the formation of an exhaust stream that is emitted from the trailing end of the missile which impacts said impact means and causes advancement of said detection means relative to said plug means upon fracture of said pin means while at the same time the advanced detection means causes release of each inserted locking ball means of said series of locking ball means from its associated radial passageway means of said plug means and the recess means of said first nozzle spray means into the chamber in order to effect ejection of the plug means from the discharge end of the first nozzle spray means and discharge of a continuous spray of pressure fluid from the first nozzle spray means to fully encompass the exhaust stream about the missile axis at its trailing end so as to form a fluid pressure safety shield thereabout; and also at the same time, as the result of the plug means being ejected from the first nozzle spray means, the valve spool means and stem means are advanced in a direction towards the bore of the first nozzle spray means in order to interconnect the other conduit means and the port means thereby causing a reduction in the pressure of the pressure fluid in the other conduit means so that the second valve means is opened and the second nozzle spray means discharges pressure fluid that forms a continuous fluid pressure spray in a direction about the missile axis at its port means exhaust stream so as to form another fluid pressure safety shield about the port means exhaust stream.

2. A system as set forth in claim 1 wherein said plug means is of plunger-like configuration.

3. A system as set forth in claim 2 wherein said plug means is provided with o-ring means for slidably and sealably connecting said plug means to the first nozzle spray means in the bore thereof.

4. A system as set forth in claim 1 wherein said impact means is of disc-like configuration.

5. A system as set forth in claim 1 wherein the other end of said first valve means includes spring means for engaging said valve spool means.

6. A system as set forth in claim 1 wherein a plurality of locking ball means is generally made up of at least a plurality of three locking ball means and wherein said series of radial passageway means is generally made up of at least one radial passageway means for each locking ball means of the plurality thereof.

7. A system as set forth in claim 1 wherein said stem means at the one end of first said valve means is generally made up of a series of interengaging ball means.

8. A system as set forth in claim 1 wherein the plug means is coaxial with the axis of said first nozzle spray means.

9. A system as set forth in claim 1 wherein said detection means is coaxial with the axis of said plug means.

10. A system as set forth in claim 1 wherein the longitudinal axes of said first valve means, spool means, and stem means are axially aligned, and wherein the axes of said first valve means, spool means, and said stem means are generally transverse to the bore longitudinal axis of said first nozzle spray means.

11. A system as set forth in claim 1 wherein the first nozzle spray means operatively associated with a stored missile has its bore longitudinal axis aligned with the stored missile axis.

12. A system as set forth in claim 1 wherein the axis of the second nozzle spray means is disposed generally transverse to the axis of a stored missile with which it is associated.

13. A system as set forth in claim 1 wherein said first nozzle spray means includes shield means disposed about and spaced from said impact means for protecting same from impact other than by an exhaust stream of an ignited missile.

* * * * *